US006226839B1

(12) United States Patent
Sayegh

(10) Patent No.: US 6,226,839 B1
(45) Date of Patent: May 8, 2001

(54) SECURING MEANS ATTACHABLE TO OBJECTS OF VARYING SIZE AND SHAPE

(76) Inventor: Adel Odeh Sayegh, 6320 Wine Ct., Alta Loma, CA (US) 91737

( * ) Notice: Subject to any disclaimer, the term of this patent is extended or adjusted under 35 U.S.C. 154(b) by 0 days.

(21) Appl. No.: 09/225,607

(22) Filed: Jan. 5, 1999

(51) Int. Cl.[7] ..... B65D 63/00; E05B 65/00

(52) U.S. Cl. ..... 24/16 PB; 24/17 AP; 24/30.5 P; 24/456; 24/704.1; 70/57.1

(58) Field of Search ..... 24/16 PB, 17 AP, 24/30.5 P, 704.1, 456, 527; 70/57.1

(56) References Cited

U.S. PATENT DOCUMENTS

| | | | | |
|---|---|---|---|---|
| 3,059,359 | * | 10/1962 | Goldammer et al. | 24/16 PB |
| 3,837,047 | * | 9/1974 | Bunnell | 24/16 PB |
| 3,860,997 | * | 1/1975 | Van Riper, Jr. et al. | 24/16 PB |
| 3,964,133 | | 6/1976 | Wasserlein, Jr. . | |
| 4,676,535 | * | 6/1987 | Mautner | 24/16 PB |
| 4,862,561 | | 9/1989 | Lichtenberg . | |
| 5,408,212 | * | 4/1995 | Meyers et al. | 340/427 |
| 5,437,172 | | 8/1995 | Lamy et al. . | |
| 5,457,853 | | 10/1995 | Klein . | |
| 5,524,463 | * | 6/1996 | Schenkel et al | 24/16 PB |
| 5,687,455 | * | 11/1997 | Alexander | 24/16 PB |
| 5,722,123 | | 3/1998 | Davignon et al. . | |

FOREIGN PATENT DOCUMENTS

| | | | | |
|---|---|---|---|---|
| 2246878 | * | 9/1972 | (DE) | 24/16 PB |
| 1212605 | * | 3/1960 | (FR) | 24/16 PB |
| 2274518 | * | 2/1976 | (FR) | 24/16 PB |
| 1348332 | * | 3/1974 | (GB) | 24/704.1 |

* cited by examiner

*Primary Examiner*—Victor N. Sakran
(74) *Attorney, Agent, or Firm*—Milord Keshishzadeh, Esq.; Milord & Associates

(57) ABSTRACT

A securing means for enclosing objects of varying size, shape, and materials that allows attachment of an electronic surveillance tag thereto. The securing means having an elongated strap portion extending from a buckle like attachment portion, whereby an end of the elongated portion is inserted into the attachment portion and thereby forms a closed loop. The object to be enclosed is maintained within the loop and the size of the loop can be adjusted by changing the point of fastening of the elongated portion to the attachment portion. To prevent the elongated portion from disconnecting, the elongated portion has a plurality of hitching means disposed thereon and they engage a latching means located on the attachment portion. A plurality of apertures are located medially on the elongated portion axially align with a hole defined by the attachment portion. A pin having a head portion and an extended portion is inserted through said hole and a selected aperture, said extended portion inserting into a locking electronic tag, whereby the elongated portion and the attaching portion are securely affixed between said head and said tag. Said tag communicating with a surveillance system to warn of the removal of the enclosed object from a predetermined region.

19 Claims, 1 Drawing Sheet

SECURING MEANS ATTACHABLE TO OBJECTS OF VARYING SIZE AND SHAPE

FIELD OF THE INVENTION

The invention relates to flexible tie apparatus that enclose objects, and in particular to a system that allows attachment of "Electronic Article Surveillance" members to articles of varying sizes, shapes, and materials.

BACKGROUND OF THE INVENTION

Flexible tie apparatus are known in the prior art and are widely used. For example, U.S. Pat. No. 3,964,133 to Wasserlein, Jr. discloses a metallic bundle tie device to primarily enclose electrical wires, and U.S. Pat. No. 4,862,561 to Lichtenberg discloses an irreversible tie strap. Neither Wasserlein nor Lichtenberg accommodate the attachment of an electronic surveillance sensor; furthermore, neither assembly allows reuse of the tie apparatus, thereby contributing to the increase in the cost of manufacturing and using the products. In addition, both inventions only allow insertion of the strap portion into the clasping member through a slit whereby the strap is pulled through until a desired length is achieved. Thus, if a long strap member engages a small article, the user would need to pull a vast amount of the strap through the clasping means thereby exacerbating temporal efficiency.

U.S. Pat. No. 5,457,853 to Klein and U.S. Pat. No. 5,722,123 to Davignon et al. disclose a somewhat similar flexible tie apparatus with clasping members attached thereto. Neither invention accommodates the attachment of an electronic surveillance sensor, nor do they allow a mechanism for attaching the strap in a locked manner to prevent removal thereof by unauthorized persons. Furthermore, both inventions lack a reinforcing means and are therefore easily removable. In addition, both inventions only allow insertion of the strap portion into the clasping member through an annular opening which also exacerbates temporal efficiency when a small object is to be enclosed by a long strap.

U.S. Pat. No. 5,437,172 to Lamy et al. discloses a flexible tie apparatus which has a hanger attached thereto. Embedded within the hanger is a tuned antenna that serves as the electronic surveillance sensor. A strap portion extends from the hanger and is adapted to only receive and bind to eyewear. Lamy is limited in the shape and size of the object that it can attach to thus limiting its function and use. In addition, Lamy only allows insertion of the strap portion into the clasping member through an annular opening thereby making the use of the invention time consuming. Furthermore, because the sensor is built into the tie apparatus, the invention becomes more expensive and difficult to produce.

U.S. Pat. No. 5,524,463 to Schenkel et al. discloses a flexible tie apparatus to be used with electronic surveillance sensors. However, the strap portion of Schenkel's device is not reinforced and can easily be cut and removed. Furthermore, the strap portion is not maintained within the channel portion where engagement occurs, thereby making insertion of the sensor mechanism cumbersome. In addition, the point of engagement between the channel portion and the strap portion is flimsy and can easily be damaged thus making replacement thereof a costly necessity.

The aforementioned flexible tie devices do not function adequately, are cumbersome to use, are not sturdy, and a few cannot be reused. Therefore, there remains a long standing and continuing need for an advance in the art beyond the existing flexible tie devices that is simpler in both design and use, is more economical, sturdy, and efficient in its construction and use, and can quickly be installed and removed from an object.

SUMMARY OF THE INVENTION

The invention relates to a flexible securing means constructed from a variety of thermoplastics, suitable metals, and any other suitable flexible material. The securing means has an elongated strap portion and a buckle like attaching portion. The elongated portion has a plurality of teeth like hitching means that removably bind with a latching means located within the attaching portion. The hitching means are preferably laterally located on the elongated portion, and the latching means are preferably located on a side wall of the attaching portion. The attaching portion has a bottom, a pair of side walls extending therefrom, and a pair of tops attached to said side walls at a point distal to said bottom.

The bottom, side walls, and tops forming a pair of parallel tracks that are of sufficient size to accommodate the elongated portion. The elongated portion can either be inserted through the opening formed between said tops, or pulled through the tracks in a horizontal plane. The hitching means and latching means are oriented such that the movement of the elongated portion is unidirectional in the horizontal plane, but the elongated portion can be removed or inserted through the opening in a vertical fashion.

The bottom also has a hole that is adapted to align axially with a specific aperture selected from a plurality of apertures on the elongated portion. After the elongated portion is inserted into the attaching portion, the elongated portion forms a closed loop that can enclose objects of varying size, shape, or material. The hitching means and the latching means engage one another and prevent the object from being released. A pin having a head as a stopper portion can be inserted through the hole and aperture and engage an electronic surveillance sensor on the other side, whereby the attaching portion and elongated portion are enclosed between the head and the sensor. In addition, reinforcing fibers are placed within or upon the securing means to prevent cutting thereof. The sensor, having an antenna therein, communicates with an alarm unit to warn of removal of an enclosed object from a predetermined region. The sensor also being only removable by a special tool maintained by authorized personnel.

Therefore, it is a primary object of the invention to provide a new and improved flexible securing means that can be used to fasten objects together, bundle objects, and perform a multiplicity of fastening operations.

It is another object of the invention to provide a securing means that can be made of one piece and is simple to construct.

It is another object of the invention to provide a securing means that can be attached and removed quickly and with ease.

It is yet another object of the invention to provide a securing means that is durable and sturdy.

It is a further object of the invention to provide a securing means that is reinforced to prevent cutting thereof.

It is another object of the invention to provide a securing means that can communicate with other securing means of the same to enclose objects with sizes on the large order.

It is another object of the invention to provide a securing means that can be made of any flexible material such as, but not limited to, thermoplastics and metals.

It is yet another object of the invention to provide a securing means that can receive an electronic surveillance sensor to monitor attempted thefts of articles attached to the securing means.

Such stated objects and advantages of the invention are only examples and should not be construed as limiting this invention. Other objects and advantages of the invention herein will become more apparent from the detailed description of the invention and the claims that follow.

DETAILED DESCRIPTION OF THE INVENTION

Figure 1:
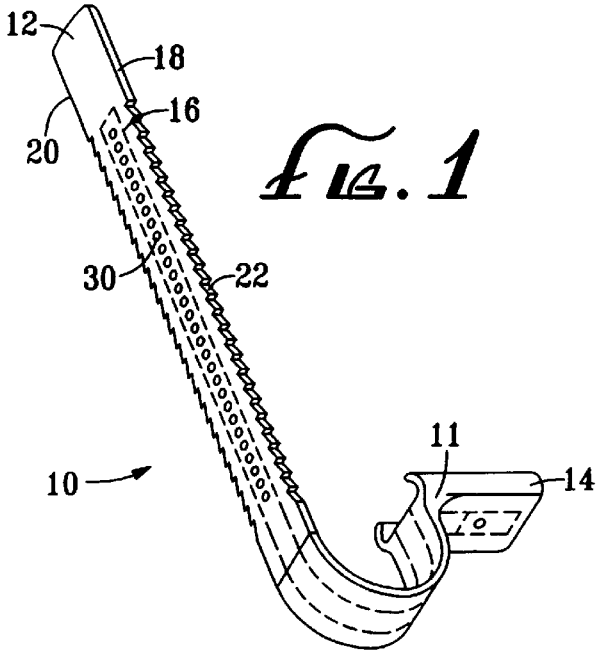
FIG. 1 is a perspective view of the securing means illustrating a reinforcement material embedded therein.

Referring now to FIG. 1, a securing means 10 is illustrated. Securing means 10 can be constructed of a variety of thermoplastics, suitable metals, and any other suitable flexible material. Securing means 10 has an elongated portion 12 that is joined to an attaching portion 14. Although attaching portion 14 is illustrated as attaching to a distal end of elongated portion 12, in alternate embodiments attaching portion 14 may be attached to the middle of elongated portion 12. At the region of attachment of attaching portion 14 and elongated portion 12, a strengthened portion 11 is formed to decrease the likelihood of damage and to increase the durability of securing means 10. Elongated portion 12 and attaching portion 14 have a reinforcing material 16 embedded therein and extending axially along the length of both portions to prevent cutting thereof. Reinforcing material 16 may be comprised of steel wires, cables, or sheet metal, or any other suitable material.

Figure 2:
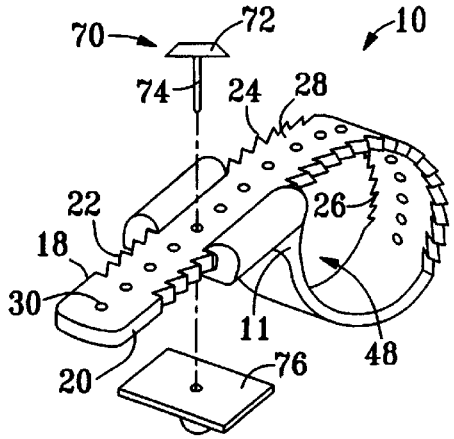
FIG. 2 is a perspective view of the securing means, wherein the strap is engaged by the attaching portion, and also illustrating an electronic surveillance sensor and pin to enclose said attaching portion and said elongated portion.

Now also referring to FIG. 2, elongated portion 12 has a first side 18 and a second side 20. Sides 18 and 20 have a plurality of hitching means 22. In addition, elongated portion 12 has a plurality of apertures 30 located longitudinally and substantially medially. Although in the preferred embodiment both sides 18 and 20 have hitching means 22, in alternate embodiments only one of said sides 18 or 20 may have hitching means 22, whereas the alternate side may be flat. Hitching means 22 are substantially "V" shaped and each has an apex 24, a valley 26, and a base 28. Hitching means 22 are angled towards the region of attachment such that apex 24 is pointed towards the region of attachment between elongated portion 12 and attaching portion 14.

Figure 3:
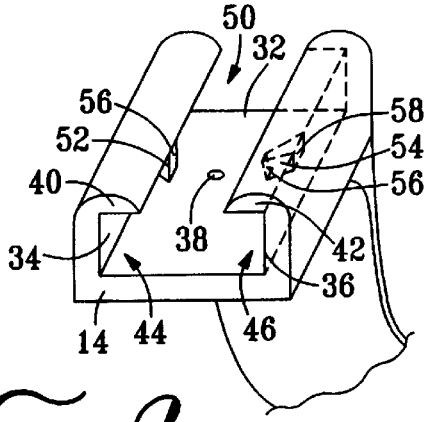
FIG. 3 is a partial perspective view of the securing means emphasizing the attaching portion wherein at least one coupling means can be located.

Now also referring to FIG. 3, attaching portion 14 has a bottom 32 interconnecting a first side wall 34 and a second side wall 36. Bottom 32 also defines a cavity 38 adapted to align with individual apertures 30 located on elongated portion 12. First side wall 34 has a first top 40 and second side wall 36 has a second top 42. Tops 40 and 42 are inwardly traversed and substantially parallel to bottom 32 such that a first conduit 44 and a second conduit 46 are respectively formed. First conduit 44 receives first side 18 and second conduit 46 receives second side 20 of elongated portion 12. Elongated portion 12 may be inserted into conduits 44 and 46 at one end and pulled through to form a closed loop 48 of desired length to enclose any object contained within loop 48.

First top 40 and second top 42 are of sufficient length to form an opening 50 to accommodate an alternate means of insertion and removal of elongated portion 12 into and out of conduits 44 and 46 directly via opening 50. In the alternate insertion method, either side 18 or is first inserted into either conduit 44 or 46 respectively, and then the remaining side 18 or 20 is inserted into their respective conduit 44 or 46. In the alternate insertion method, the time required to pull elongated portion 12 through conduits 44 and 46 is reduced. In addition, the size of loop 48 can be approximated to the size of an object to be enclosed which prevents the object from slipping through loop 48 while elongated portion 12 is being pulled through conduits 44 and 46. Opening 50 also serves as a release mechanism whereby elongated portion 12 can be lifted therethrough and out of conduits 44 and 46 to quickly and efficiently release an enclosed object from loop 48.

Contained within conduits 44 and 46 are a first latching means 52 and a second latching means 54. Latching means 52 and 54 are substantially "V" shaped and are adapted to allow elongated portion 12 to be pulled through conduits 44 and 46 in a forward direction, but they prevent withdrawal of elongated portion 12 in a backwards direction. Latching means 52 and 54 have a tip portion 56 and a foundation portion 58. Foundation portion 58 of each latching means 52 and 54 connects to side walls 34 and 36 respectively, such that tip portion 56 can fluctuate between an engaging position and a pull through position. In an engaging position, tip portion 56 inserts within valley 26 of hitching means 22. Whereas in a pull through position, tip portion 56 is bent into close proximity with respective side walls 34 and 36 and apex 24 of hitching means 22. The resiliency of the material used in construction of latching means 52 and 54 allows the fluctuation to occur in relation to the position of elongated portion 12 and respective hitching means 22.

Figure 4:
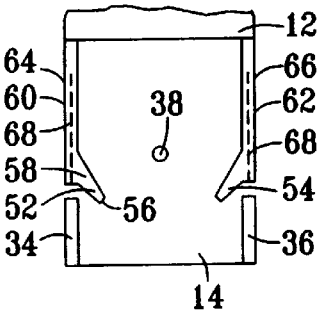
FIG. 4 is a top plan view of an alternate embodiment of the attaching portion illustrating an alternate embodiment for the coupling means, wherein the tops of the side walls are not illustrated.
Figure 5:
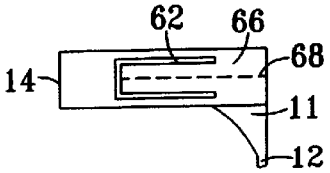
FIG. 5 is a partial side view of the attaching portion embodiment of FIG. 4.
Figure 6:
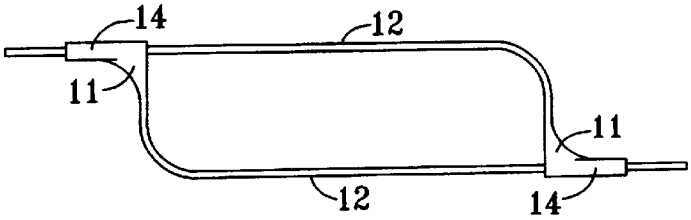
FIG. 6 is a side view of a pair of securing means communicating with one another.

In an alternate embodiment of a latching mechanism, as more clearly illustrated in FIGS. 4 and 5, latching means 52 and 54 are connected to a first lever 60 and a second lever 62 respectively. Levers 60 and 62 may be created from respective side walls 34 and 36, wherein a longitudinally and medially located portion of the respective walls 34 and 36 has only a first axial point 64 and a second axial point 66 of attachment respectively. Levers 60 and 62 may have a respective resiliency element 68 embedded therein. In such an embodiment, as elongated portion 12 is pulled through conduits 44 and 46, apex 24 pushes on tip 56 and forces respective levers 60 and 62 laterally and outside the axis of side walls 34 and 36. In are engaged position, levers 60 and 62 are axially located with respective side walls 34 and 36, and tip 56 of latching means 52 and 54 is located within valley 26 of hitching means 22.

Now referring particularly to FIG. 2, after an object to be enclosed is maintained within loop 48 and elongated portion 12 and attaching portion 14 are in an engaged position, cavity 38 and one of said apertures 30 are axially aligned to receive a pin 70. Pin 70 has a head portion 72 and an extended portion 74. Head portion 72 is sufficiently sized to cover aperture 30 and cavity 38, and more preferably, head portion 72 if of sufficient size to traverse opening 50 and become disposed upon first top 40 and second top 42 concurrently. Extended portion 74 extends through and out of aperture 30 and cavity 38 where it engages a sensor 76. Sensor 76 can be any conventionally available electronic tag as supplied by Sensormatic®, Checkpoint®, or any of such companies. Authorized users may remove sensor 76 by using special equipment supplied by the manufacturer. With securing means 10 enclosing a desired object and with attachment of sensor 76 thereto, attempted theft of the object can be detected and deterred.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A securing means, comprising:

an elongated portion having an attaching portion affixed thereto via a strengthened portion;

said attaching portion being reusable and being adapted to receive and removably retain said elongated portion therein, such that said elongated portion forms a loop to enclose a desired object within said loop;

said elongated portion having a plurality of hitching means thereon, and said hitching means communicating with a latching means disposed on said attaching portion;

said attaching portion having a bottom disposed between a first side wall and a second side wall, said first side wall having a first top and said second side wall having a second top, an opening being formed between said first top and said second top;

said first top, said first side wall, and said bottom forming a first conduit, and said second top, said second side wall, and said bottom forming a second conduit; and said conduits being of sufficient size to accommodate said elongated portion.

2. The invention of claim 1, wherein said elongated portion has a first end and a second end, and said ends being interconnected by a first side and a second side;

said second end being attached to said attaching portion;

said hitching means being laterally disposed upon said first side and said second side.

3. The invention of claim 2, wherein each of said hitching means has an apex and a base, said base being attached to said side of said elongated portion;

said apex being pointed towards said second end of said elongated portion to form an acute angle with said side of said elongated portion.

4. The invention of claim 1, wherein a plurality of apertures are located substantially medially and longitudinally along said elongated portion.

5. The invention of claim 4, wherein a reinforcement material such as, but not limited to, a steel cable is embedded within said elongated portion and said attaching portion and extends longitudinally to encircle said plurality of apertures and to encircle a cavity located on said attaching portion.

6. The invention of claim 1, wherein a latching means is connected to at least one of said first side wall and said second side wall.

7. The invention of claim 1, wherein a first latching means is connected to said first side wall and a second latching means is connected to said second side wall via a respective foundation portion of said first and said second latching means;

said first and said second latching means both having a respective tip distal to said respective foundation portion, and said tip being oriented away from the point of affixment of said elongated portion and said attaching portion.

8. The invention of claim 1, wherein a portion of at least one of said first side wall and said second side wall is excised to form a lever;

said lever having an end attached to said wall and functioning as a rotational axis;

said lever also having a latching means disposed thereon.

9. The invention of claim 8, wherein said latching means is located at an end of said lever distal to said rotational axis;

said latching means being disposed upon said lever such that it is contained within said conduit when engaging said hitching means;

said lever and said latching means being able to traverse laterally out of alignment of said walls when not engaging said hitching means.

10. The invention of claim 8, wherein said lever has a resilient means disposed at least therein and thereon.

11. The invention of claim 8, wherein said latching means has a tip and a foundation, said foundation being attached to said lever and said tip being distal to said foundation;

said tip being oriented away from the point of affixment of said elongated portion and said attaching portion.

12. The invention of claim 8, wherein said latching means is oriented to engage said hitching means to only allow horizontal movement in a unidirectional fashion;

said latching means being oriented such that said elongated portion can be removed and inserted in a vertical fashion through said opening.

13. The invention of claim 1, wherein a reinforcement material is disposed at least on and embedded within said elongated portion and said attaching portion;

said securing means being made of a material selected from the group consisting of thermoplastics, metals, and flexible materials.

14. The invention of claim 1, wherein said securing means is constructed from a unitary piece of material.

15. The invention of claim 1, wherein said elongated portion has a plurality of apertures and said attaching portion has a hole therein;

said hole and a desired one of said apertures being axially oriented when said hitching means is engaged by said latching means;

said hole and said aperture receiving an extended portion of a pin;

said pin having an adequately sized head portion located at a first end of said extended portion; a second end of said pin communicating with a locking portion and enclosing said elongated portion and said attaching portion within said head portion and said locking portion to prevent removal of said securing means by unauthorized individuals;

said locking means having a tuned antenna therein and communicating with a detecting device to warn of removal of said securing means and said object from a predetermined region.

16. The invention of claim 1, wherein a plurality of said securing means may communicate with one another to form a loop of any desired length.

17. A theft deterrent securing means comprising:

a unitary body, said body having an elongated portion communicating with an attaching portion wherein said elongated portion and said attaching means are strengthened at the communication region;

said elongated portion having at least a hitching means thereon, and said elongated portion also having at least one aperture located substantially medially and longitudinally;

said attaching portion having a latching means adapted to communicate with said hitching means on said elongated portion thereby forming a loop defined by said elongated portion and enclosing an object therein;

said attaching portion having a bottom disposed between a pair of side walls, and each of said a side walls having a top, an opening being defined by said tops, and said bottom defining a hole therein;

said hole of said attaching portion and said aperture of said elongated portion being adapted to align axially;

a pin having an extended portion passing through said hole and said aperture, and said pin also having a head portion at a first end of said extended portion and said head portion being sufficiently sized to prevent said pin from passing through said hole and said aperture;

a sensor locking means receiving a second end of said extended portion, whereby said elongated portion and said attaching portion are maintained between said head and said sensor locking means to prevent theft of the object enclosed within said loop.

18. The invention of claim 17, wherein said hitching means are located laterally on said elongated portion.

19. A securing means used in electronic article surveillance comprising:

a unitary body, said body having an elongated portion communicating with an attaching portion wherein said elongated portion and said attaching means are strengthened at the communication region;

said elongated portion having at least a hitching means disposed laterally thereon, and said elongated portion also having at least one aperture located substantially medially and longitudinally;

said attaching portion having a latching means adapted to communicate with said hitching means on said elongated portion thereby forming a loop defined by said elongated portion and enclosing an object therein;

said attaching portion having a bottom disposed between a pair of side walls, and each of said side walls having a top, an opening formed between said tops, and said bottom defining a hole therein;

said hole of said attaching portion and said aperture of said elongated portion being adapted to align axially;

said latching means being located in a channel formed by said bottom, said side wall, and said top;

a pin having an extended portion passing through said hole and said aperture, and said pin also having a head portion at a first end of said extended portion and said head portion being sufficiently sized to prevent said pin from passing through said hole and said aperture;

a sensor locking means receiving a second end of said extended portion;

whereby said elongated portion and said attaching portion are maintained between said head and said sensor locking means to prevent theft of the object enclosed within said loop.

* * * * *